US007284392B2

(12) United States Patent
Anderson et al.

(10) Patent No.: US 7,284,392 B2
(45) Date of Patent: Oct. 23, 2007

(54) REFRIGERATOR ICEMAKER WITH WIRING HOOKS

(75) Inventors: Ronald K. Anderson, Sidney, OH (US); Troy Michael Anderson, Marion, IA (US); Thomas Carl Anell, Knoxville, IL (US); Xiaoyong Fu, Plano, TX (US); James H. Jenkins, Jr., South Amana, IA (US); Bruce Arthur Kopf, Cedar Rapids, IA (US); Ryan D. Schuchart, Cedar Rapids, IA (US); Andrew G. Strohm, Cedar Rapids, IA (US); Scott Robert Voll, Cedar Rapids, IA (US); Dennis E. Winders, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/421,788

(22) Filed: Jun. 2, 2006

(65) Prior Publication Data

US 2006/0266066 A1 Nov. 30, 2006

Related U.S. Application Data

(63) Continuation of application No. 11/140,100, filed on May 27, 2005.

(51) Int. Cl.
*F25C 1/12* (2006.01)

(52) U.S. Cl. ..... 62/347; 62/353

(58) Field of Classification Search ..... 62/340–356
See application file for complete search history.

(56) References Cited

U.S. PATENT DOCUMENTS

| | | | | |
|---|---|---|---|---|
| 1,126,658 | A | | 1/1915 | Roughton |
| 2,970,453 | A | * | 2/1961 | Harle et al. ..... 62/135 |
| 3,046,754 | A | | 7/1962 | Kniffin |
| 3,270,519 | A | | 9/1966 | Pohl |
| 3,276,225 | A | | 10/1966 | Linstromberg |
| 3,331,215 | A | | 7/1967 | Shaw |
| 3,362,181 | A | | 1/1968 | Linstromberg |
| 3,540,227 | A | | 11/1970 | Eyman, Jr. |
| 3,581,516 | A | | 6/1971 | Buchser |
| 3,601,145 | A | | 8/1971 | Eyman, Jr. |
| 3,727,427 | A | | 4/1973 | Eyman, Jr. |
| 3,788,089 | A | | 1/1974 | Graves |
| 3,828,568 | A | | 8/1974 | Frazier |
| 3,850,008 | A | | 11/1974 | Frazier |
| 3,863,461 | A | | 2/1975 | Bright |

(Continued)

FOREIGN PATENT DOCUMENTS

EP 657706 A1 6/1995

(Continued)

*Primary Examiner*—William E. Tapolcai
(74) *Attorney, Agent, or Firm*—Michael D. Lafrenz; Kirk Goodwin

(57) ABSTRACT

An improved icemaker is provided for a refrigerator. The improvements include tilting the ice mold to assure that the ice cavity nearest the thermostat is filled with water; controlling air flow to the mold to promote rapid freezing of water in the mold cavities; raising the perimeter walls of the mold to minimize water spillage; and providing hooks on the mold for routing electrical wires.

19 Claims, 17 Drawing Sheets

U.S. PATENT DOCUMENTS

| | | | | |
|---|---|---|---|---|
| 3,926,007 | A | 12/1975 | Braden | |
| 4,474,023 | A | 10/1984 | Mullins, Jr. | |
| 4,614,088 | A | 9/1986 | Brooks | |
| 4,649,717 | A | 3/1987 | Tate, Jr. et al. | |
| 4,649,718 | A | 3/1987 | Linstromberg | |
| 4,665,708 | A | 5/1987 | Tate, Jr. et al. | |
| 4,719,762 | A | 1/1988 | Osabe | |
| 4,756,165 | A | 7/1988 | Chestnut | |
| 4,800,731 | A | 1/1989 | Cole | |
| 4,835,978 | A | 6/1989 | Cole | |
| 4,838,026 | A | 6/1989 | Searl | |
| 4,852,359 | A | 8/1989 | Manzotti | |
| 4,866,948 | A | 9/1989 | Cole | |
| 4,872,317 | A | 10/1989 | Reed | |
| 4,896,513 | A | 1/1990 | Troscinski | |
| 5,010,738 | A | 4/1991 | Brown et al. | |
| 5,056,321 | A | 10/1991 | Patrick | |
| 5,056,322 | A | 10/1991 | Patrick | |
| 5,160,094 | A | 11/1992 | Willis | |
| RE34,174 | E | 2/1993 | Brown | |
| 5,212,955 | A | 5/1993 | Hogan | |
| 5,261,248 | A | 11/1993 | Willis | |
| 5,272,888 | A | 12/1993 | Fisher | |
| 5,329,786 | A | 7/1994 | Willis | |
| 5,596,182 | A | 1/1997 | Edwards | |
| 5,823,001 | A | 10/1998 | Patrick | |
| 6,050,097 | A | 4/2000 | Nelson | |
| 6,082,130 | A | 7/2000 | Pastryk | |
| 6,148,624 | A | 11/2000 | Bishop | |
| 6,176,099 | B1 | 1/2001 | Hynes | |
| 6,216,471 | B1 * | 4/2001 | Patrick et al. | 62/71 |
| 6,351,955 | B1 * | 3/2002 | Oltman et al. | 62/71 |
| 6,588,219 | B2 * | 7/2003 | Zevlakis | 62/73 |
| 6,588,227 | B2 | 7/2003 | Kim | |
| 6,637,217 | B2 | 10/2003 | Kim et al. | |
| 6,658,869 | B1 | 12/2003 | Thornbrough | |
| 6,945,068 | B2 * | 9/2005 | Kim et al. | 62/353 |
| 6,964,177 | B2 | 11/2005 | Lee | |
| 7,065,975 | B1 | 6/2006 | Herndon et al. | |
| 7,076,967 | B2 | 7/2006 | Lee et al. | |
| 2006/0090496 | A1 | 5/2006 | Adamski et al. | |

FOREIGN PATENT DOCUMENTS

| | | | |
|---|---|---|---|
| EP | 1445558 | | 11/2003 |
| EP | 1482263 | A2 | 1/2004 |
| GB | 2167544 | | 10/1985 |
| JP | 500 69644 | | 6/1975 |
| JP | 08121919 | A | 5/1996 |
| JP | 10103828 | | 4/1998 |
| JP | 2003139447 | A | 5/2003 |
| WO | WO 03/102481 | A1 | 12/2003 |
| WO | WO 2004/085937 | A1 | 10/2004 |

* cited by examiner

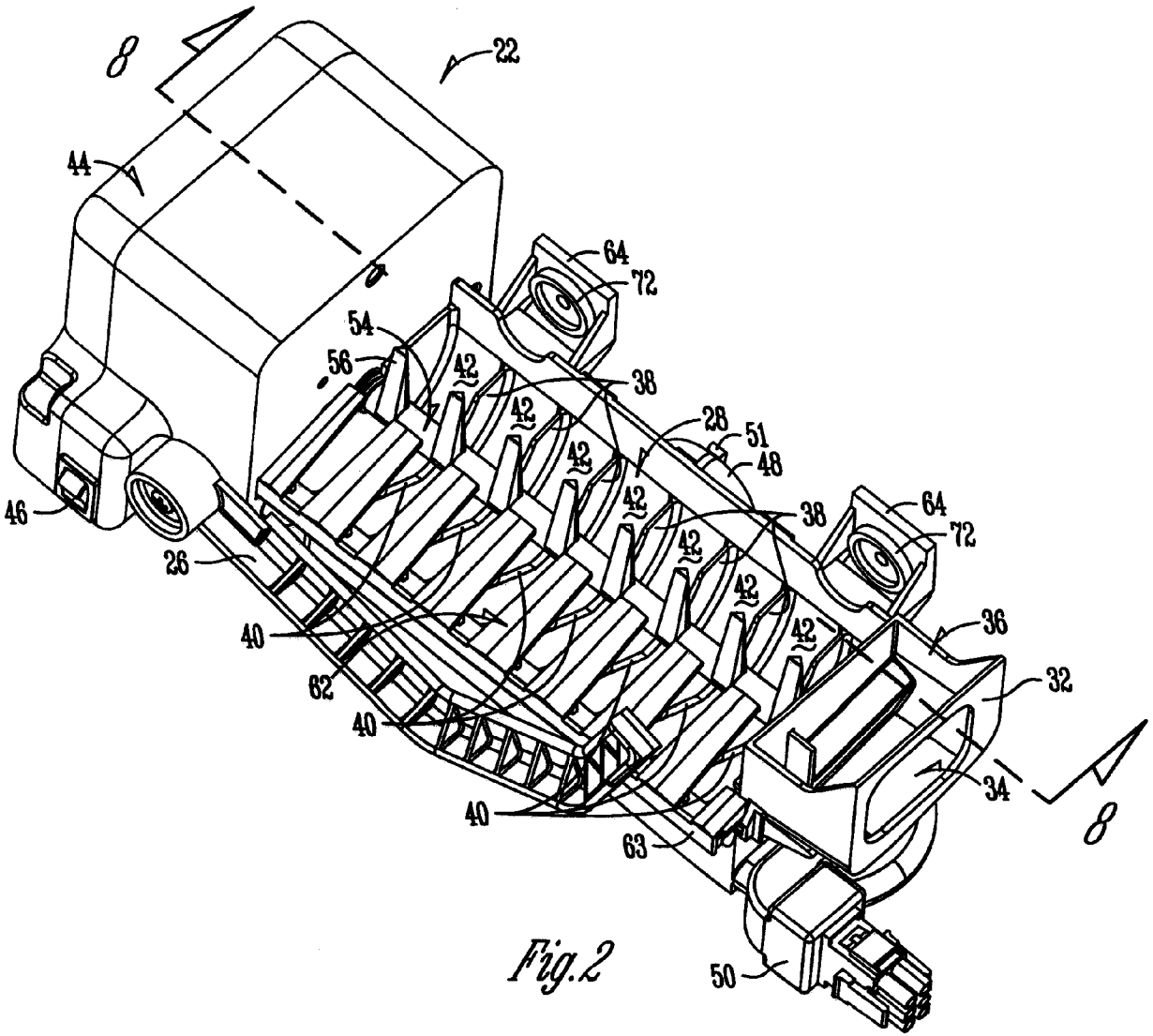
22
44
46
8
8
64
72
64
72
38
38
28
51
48
54
56
42
42
42

REFRIGERATOR ICEMAKER WITH WIRING HOOKS

CROSS-REFERENCE TO RELATED APPLICATIONS

This application is a Continuation application of U.S. application Ser. No. 11/140,100 filed May 27, 2005, which application is hereby incorporated by reference in its entirety.

BACKGROUND OF THE INVENTION

The present invention relates to an improved icemaker for freezer or icemaking compartments.

The prior art icemakers suffer from a variety of issues relative to operation, ice formation, ice harvest without water spillage, quality issues, attachment issues to the inside of the refrigerator compartment, etc. These problems have been exasperated by the fact that a significant design effort has not been overtaken by the industry for many years. While the industry has seen some incremental changes to the icemaker design, they have focused mainly on components outside the icemaker mold as the mold portion is very expensive to redesign and place into production. In general, the industry has taken an attitude that the current icemakers work well enough.

Unfortunately, the prior art icemakers do not work well. Ice is often formed with many trapped air bubbles forming "white" instead of clear ice. Additionally, production of ice cubes is slow and icemakers take up a significant portion of the freezer capacity. Moreover, service calls resulting from prior art icemaker malfunctions are high and detract from the bottom line of a company.

The present invention solves or minimizes these problems and others as evident in the following specification and claims.

BRIEF SUMMARY OF THE INVENTION

The foregoing objectives may be achieved with an improved icemaker having an ice mold.

A further feature of the present invention is an improved icemaker having an ice stripper that protects ice from falling back into the ice cavities after the ice is ejected but yet minimizes the amount of obstruction along a wall of the ice mold from cold freezer air used to freeze the water. The ice stripper may also include vertically extending ribs that help assist in creating convective air.

A further feature of the present invention is an icemaker that may be positioned on different sides of the storage compartment without compromising the effectiveness of the icemaker.

A further feature of the improved icemaker is multiple means of mounting the icemaker including plate mounting, button style mounting, and impingement duct mounting.

A further feature of the present invention includes a control system that does not permit an external fan to blow while a heating coil is engaged.

A further feature of the present invention is an externally mounted thermostat that sandwiches the thermostat between a control housing of the icemaker and the mold to firmly hold the thermostat in place for effective contact against the first ice cavity of the ice mold.

A further feature of the present invention is an improved thermal cutoff switch location that is positioned to contact an extension member of the ice mold placed within the control housing.

A further feature of the present invention is a modular bale arm that operates at a pivot point of the control housing.

A further feature of the present invention is an icemaker heating coil clenching method that firmly positions the heating coil to the bottom of the ice mold.

A further feature of the present invention are longitudinal running bottom fins that effectively transfer heat across the bottom of the ice mold in low air flow conditions from a convectional vent at the rear of the freezer department.

A further feature of the present invention is an icemaker that has raised walls for a non-spill feature in conditions in which the icemaker is misplaced plus/minus 5.6 degrees from front to back and plus/minus 10.2 degrees from side to side.

A further feature of the present invention is a tilted forward ice cube tray that positions the ice mold approximately 1.5 degrees higher at the back end than at the door end of the icemaker to ensure that the ice cube cavity closest to the thermostat is filled with water.

A further feature of the present invention is the inclusion of two lower front weirs that assure that the ice cube portion nearest the control housing is filled with water.

A further feature of the present invention is an improved ice ejector that does not interfere with the crown of ice that is formed during the normal freezing process.

A further feature of the present invention is a mold with a center weir opening to assure that the ice mold is filled regardless of the mounting orientation of the mold within the storage compartment.

A further feature of the present invention are wire ready mold hooks that permit a icemaker cord to be wrapped around the hooks to reduce its length to accommodate a variety of different positions within a freezer compartment.

A further feature of the present invention is a fill cup funnel inlet that is splayed outward to facilitate more accurate installation and thereby reduce potential for water to be spilled within the ice storage compartment.

A further feature of the present invention is an impingement duct which accelerates the formation of ice within the ice mold.

A further feature of the present invention is a water fill location at the center or one end of the ice mold to facilitate the thermostat being able to better determine that it is proper to eject ice from the cavities.

A further feature of the present invention is multiple water fill level sensors to better determine the optimum fill volume of the ice cavities.

A further feature of the present invention is an ice mold having a larger cube near the temperature sensor to better facilitate control of the ice ejector of the icemaker.

A further feature of the present invention is individual fill of ice mold cavities to assure proper filling of all ice mold cavities.

A further feature of the present invention is a straight shot of fill water down the mold lower rear side to assure that all ice cavities are filled with water.

A still further feature of the present invention is a step mold icemaker that reduces the amount of problems an ice mold may have as a result of unlevel mounting.

BRIEF DESCRIPTION OF THE DRAWINGS

FIG. 2 is a top perspective view of the icemaker of the present invention.

DETAILED DESCRIPTION

Overview

Figure 1:
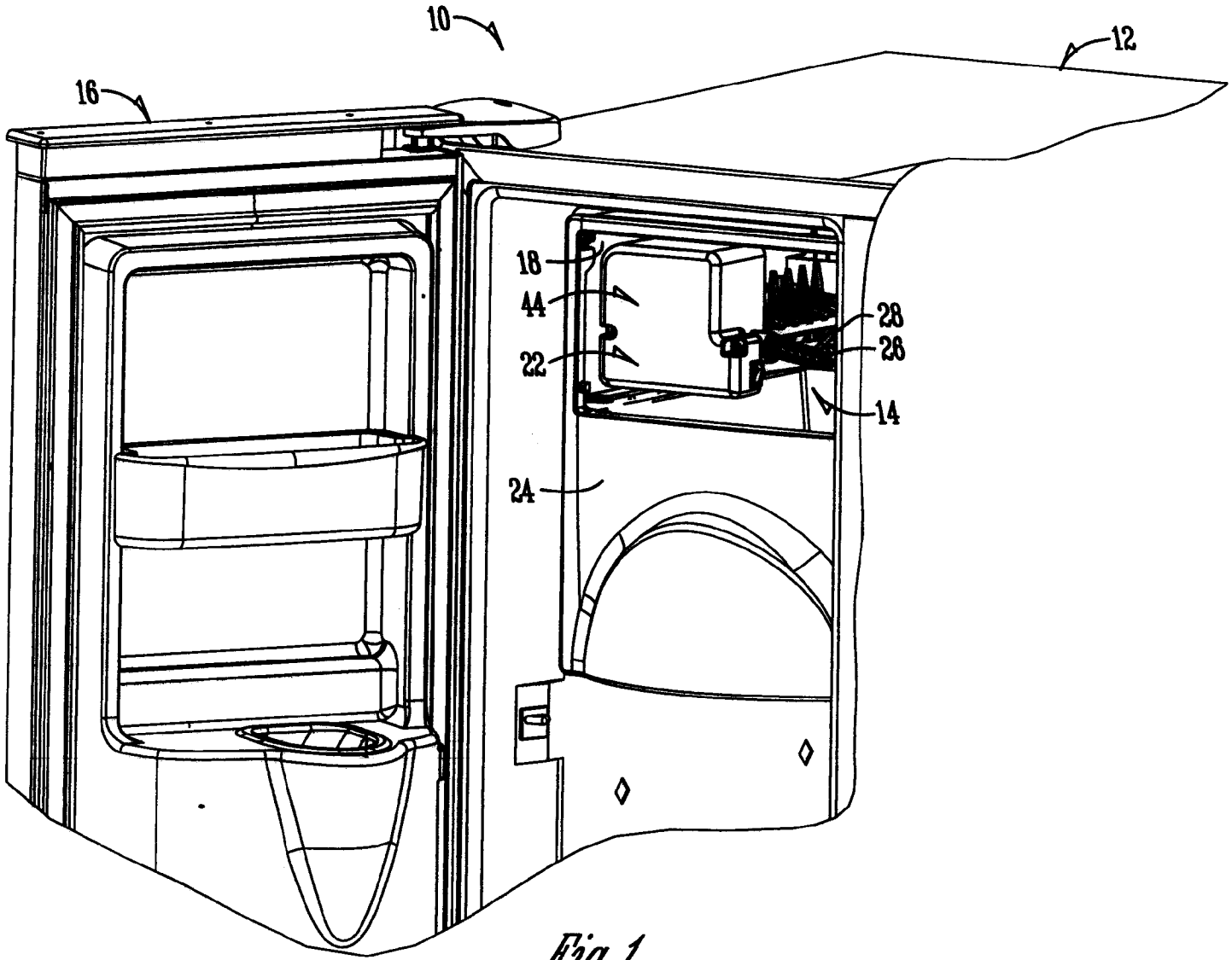
FIG. 1 is a perspective view of the icemaker of the present invention within a storage compartment of the refrigerator.

With initial reference to FIG. 1, a refrigerator, generally indicated by numeral 10, includes a cabinet 12 within which is defined a storage compartment 14. Storage compartment 14 may be selectively accessed through the pivoting of door 16. As shown, refrigerator 10 is a side-by-side style unit. However, it should be understood that the refrigerator may be a top freezer refrigerator, a bottom freezer refrigerator, a stand alone freezer, a stand alone refrigerator with a specialty icemaker compartment, a bottom freezer having a specialty ice making compartment in the refrigerator compartment, or other refrigerators known in the art.

Arranged within the storage compartment 14 is an icemaker 22. The icemaker 22 has positioned underneath it an ice storage bin 24. The icemaker 22 is shown to include a bale arm 26 which is rotatable upward and downward based on the amount of ice retained in the ice storage bin 24.

The icemaker 22 includes an ice mold 28. The icemaker 22 receives water directed to the ice mold 28 through a fill tube 30.

Figure 18:
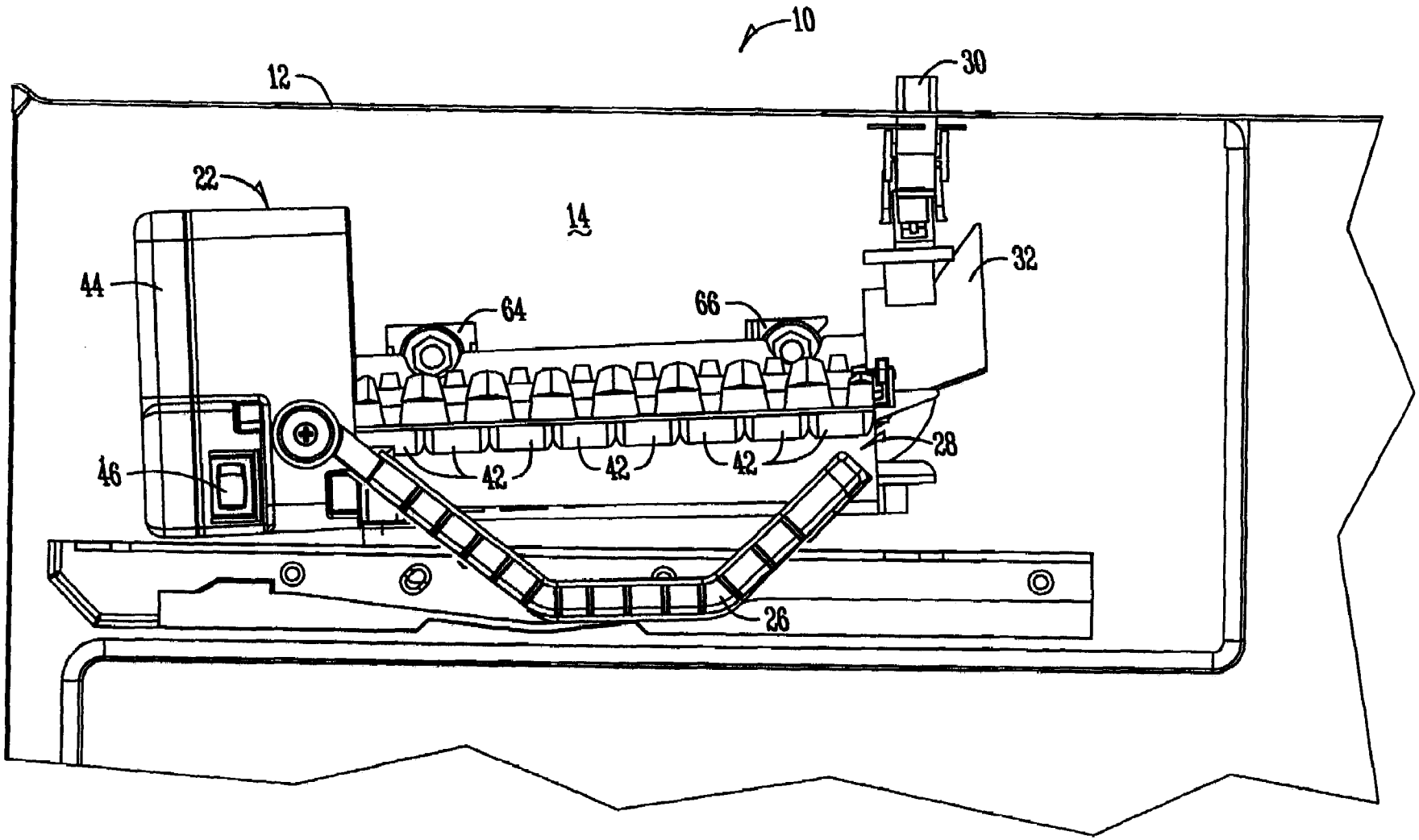
FIG. 18 is a side view of the icemaker within the freezer compartment showing the 1.5 degree forward tilt of the icemaker.

As seen more clearly in FIG. 18, the fill tube 30 may be positioned adjacent a fill cup 32 which prevents the water from spilling or splashing into the storage compartment. The fill cup 32 may receive the fill tube 30 from a rear opening 34 or a top opening 36. The fill cup 32 directs the water into the ice mold 28. The ice mold 28 has weirs 38 partitioning the ice mold 28 into individual cube cavities 42. The weirs 38 have an opening 40 which permits water to move from the fill cup 32 into individual cavities for forming ice cubes. In use, the water is turned into ice primarily through either conductive or convective heat exchange within the storage compartment 14.

A control housing 44 is attached to the ice mold 28. The control housing 44 contains the electromechanical components of the icemaker 22. An on/off switch 46 is provided on the outside of the control housing 44. A cord 48 is provided for power and/or control commands to be routed to the control housing 44. A plug 50 is provided at the end of the cord 48 to mate with a socket placed within a wall or ceiling of the storage compartment 14. The cord 48 may be held in place against the ice mold 28 by at least one routing hook 51.

Figure 11:
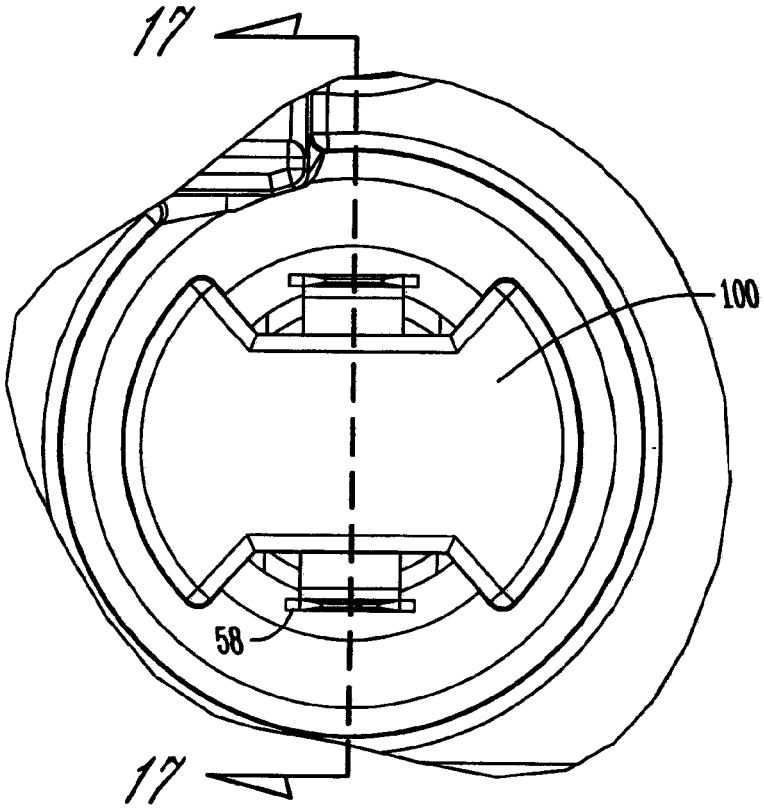
Figure 12:
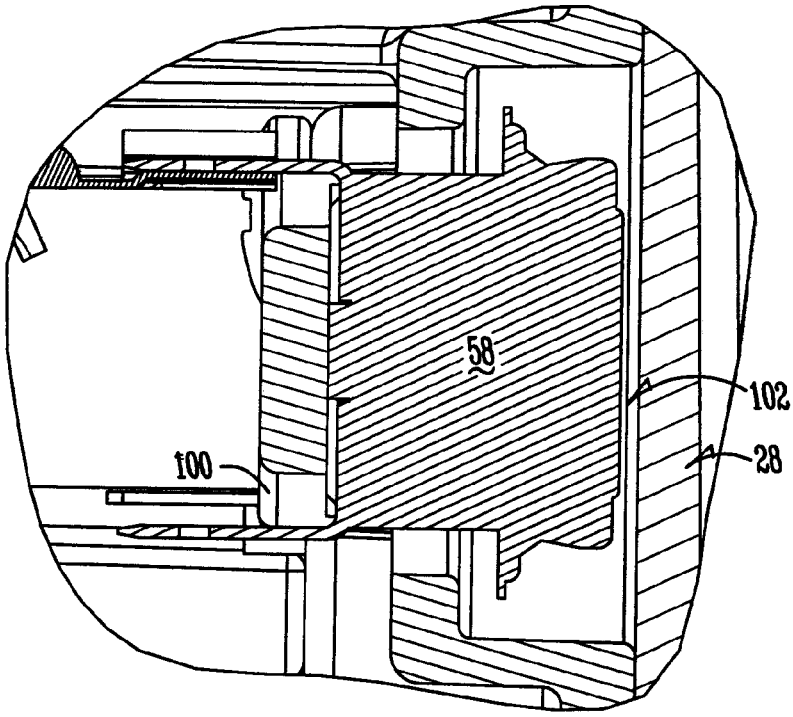

The control housing encloses a motor to activate an ejector arm 54. The ejector arm 54 has fingers 56 for each cavity 42. The control housing also encloses a thermostat 58 and a thermal cut-off unit 60 (See FIGS. 11 and 12).

The thermostat 58 is positioned in contact with the ice mold next to the cavity 42 nearest the control housing. The thermostat 58 is selected to close an electrical circuit at a designated temperature to engage the motor powering the ejector arm 54 and thus initiate an ice harvest. Under normal operating conditions which has some degree of inconsistent convection, this temperature registered by the thermostat is selected to be 15°-17° F.; however, under low or repentable airflow conditions the thermostat may be selected to send a signal at temperatures as high as 30°-31° F. In any event, the thermostat should not initiate the ejector arm when any of the cavities have liquid within them. When only one thermostat is being used, it is preferred that the icemaker is biased such that the cavity to which the thermostat is in contact has water in it that freezes last. Alternatively, multiple thermostats may be used and a control system utilized that only initiates the ejector arm 54 when all thermostats are below a set-point temperature.

The thermal cut-off unit 60 is provided as a safety measure. The icemaker utilizes a high wattage heating coil 57 (FIG. 17) to heat the underside of the ice mold 28. The thermal cut-off unit 60 is provided to cut power to the high wattage heating coil 57 in the event that the high wattage heating coil 57 malfunctions. During a malfunction, the high wattage heating coil 57 remains on creating a temperature rise outside normal operating parameters.

In normal operation, the water in the cavities 42 is frozen, the heating coil 57 turned on, and the motor engaged to release ice cubes. The motor moves the ejector arm 54 to rotate the fingers 56 through notches in the ice stripper 62 to engage the ice and remove them from the ice mold 28. The ice stripper 62 prevents ice from reentering into the ice mold 28. The ejector arm 54 returns to its starting position after two revolutions and engages a switch which indicates that water may again fill the ice mold 28.

Improved Ice Stripper

As seen in the FIG. 2, the ice stripper 62 has a small strip skirt 63. The strip skirt 63 slides upon a longitudinal rail of the ice mold 28. The strip skirt 63 permits the side of the ice mold 28 to be exposed for heat transfer. This is in sharp contrast to the prior art which had a skirt that extended substantially down along the side of the icemaker and consequently heat exchange from cool air hitting the icemaker 22 did not transfer to the ice mold 28.

An additional improvement to the ice stripper 62 may include upward extending fins (not shown). The ice stripper 62 as shown in FIG. 2 has ribs that extend over the cavities 42. These ribs are separated by notches through which the ejector fingers 56 pass through. Each rib may have an upward extending fin (not shown). These fins are centered upon the rib. The rib's midline is preferably centered upon each of the weirs 38 thus placing the fins directly above the weirs 38. The fins enhance airflow and improve the rate that ice is formed.

Icemaker Positioning

The icemaker 22 may be positioned in the storage compartment 14 at different positions. The present icemaker assembly permits positioning upon various sides of the storage compartment 14. Moreover, the icemaker unit 22 may be positioned within different compartments of the refrigerator including a top mount freezer, a side-by-side freezer, a bottom mount freezer, and within an ice box.

Icemaker Mounting

The icemaker unit may be attached to the storage compartment 14 with different mountings. These mountings may include hangers, platforms and/or compartments. Mounting brackets are provided upon the icemaker assembly. The brackets are typically integrally formed with the ice mold 28.

a. Plate Mounting

Figure 3A:
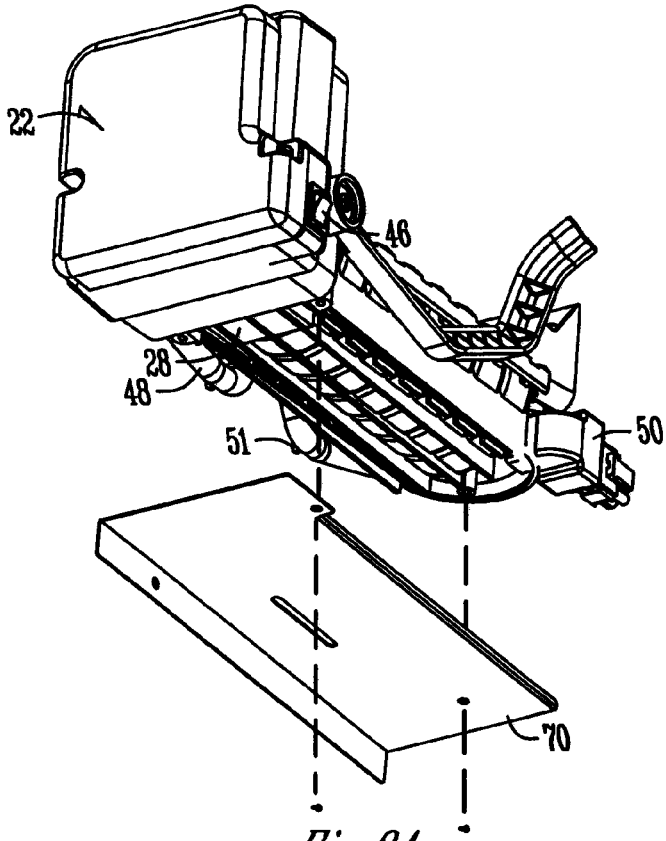
FIG. 3A is a perspective view of the icemaker of the present invention being installed upon a bottom plate for mounting within the refrigerator wall.
Figure 3B:
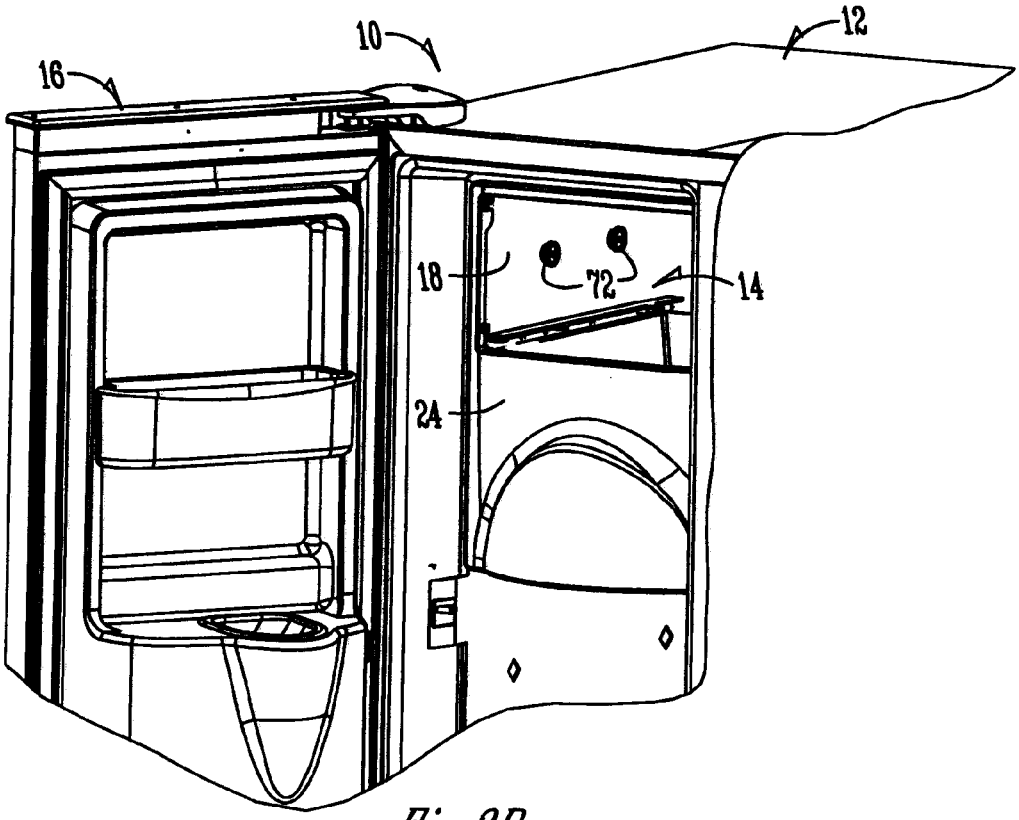
FIG. 3B is a perspective view of a refrigerator having mounting buttons upon a wall of the refrigerator for mounting the icemaker.

As seen in FIG. 3A, the icemaker 22 may be mounted to a plate 70. The plate 70 may then be attached to a wall of the storage compartment 14.

b. Button Style Mounting

Figure 4A:
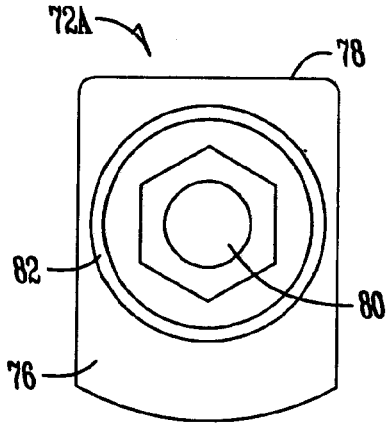
FIGS. 4A-C show different aspects of the button mounting for the icemaker.

As seen in FIG. 4A, a button 72A may be attached to the inner surface of a storage compartment 14. The button 72A may be attached by a screw as previously done by Maytag Corporation. The button 72A is used primarily with refrigerators 10 that are retrofit to include an icemaker.

Figure 4B:
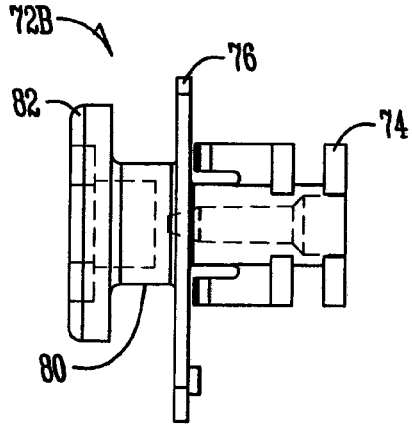
Figure 4C:
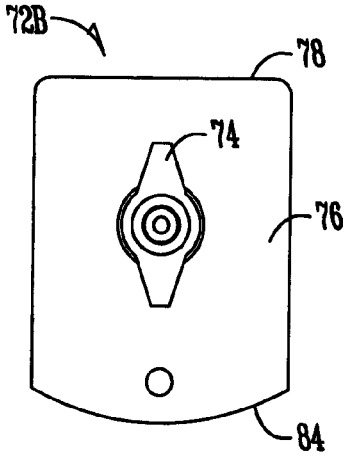

An improved button 72B may be provided as illustrated in FIGS. 4B-4C for refrigerators that come preassembled with an icemaker 22. In this scenario, it is more industrious to provide button 72B which does not include a separate threaded fastener but rather utilizes a twist and lock fastener 74. During the manufacture of the refrigerator storage compartment 14 a lateral slit is provided in the wall 18. A twist and lock fastener 74 has a lateral dimension greater than its longitudinal dimension. Therefore, the twist and lock fastener 74 may be inserted into the lateral slit on wall 18 when its lateral dimension is aligned with the lateral slit. The twist and lock fastener 74 is then fully inserted into the wall until a back plate 76 of the button 72B strikes the wall 18.

The back plate 76 has a square top 78. As the user is putting this in sideways, the shape difference between the flat square top 78 and a rounded bottom 84 provides a reference for the user to turn button 72B to place it in an optimal position such that the twist and lock fastener 74 may not come out of the lateral slit. The user may use a hex fitting to assist in rotating the button 72B into a locked position.

The button, either 72B or 72A, has a small inner diameter 80 and a larger outer diameter 82. Two buttons together cooperate with brackets 64 upon the icemaker unit 22. As seen in FIG. 2, the brackets 64 may both be designed with a longitudinal opening.

Figure 5A:
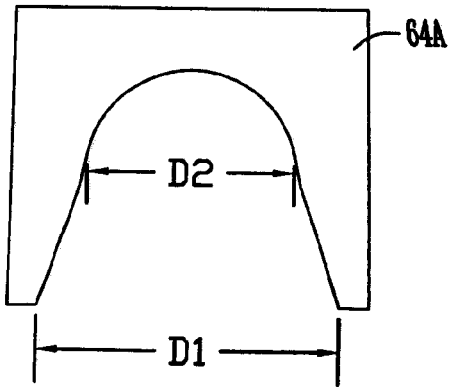
FIGS. 5A and 5B illustrate different mounting bracket configurations for the icemaker.
Figure 5B:
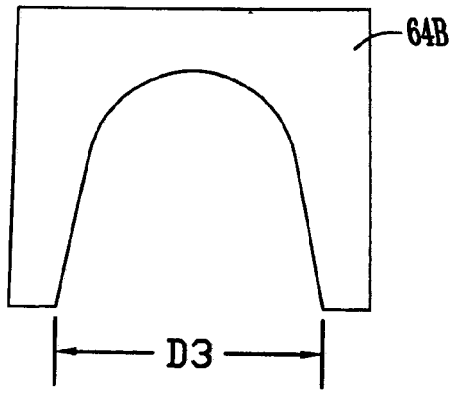

As seen in FIG. 5A, the bracket 64A may be designed to have a first diameter (D1) which accommodates insertion of the outer diameter 82 of the button and then have the button slide up the bracket 64 to a portion that has a second diameter (D2) that engages the inner diameter 80. Alternatively as seen in 5B, the bracket 64B may be a longitudinal channel having a diameter (D3) which is less than the outer diameter 82. When installing the icemaker having the bracket 64A, the bracket is moved laterally over the button 72 and then slid downward upon the button. Using the bracket 64B, the user is able to slide the bracket down over the button, without moving the bracket laterally over the button prior to downward movement of the bracket 64B.

Figure 6A:
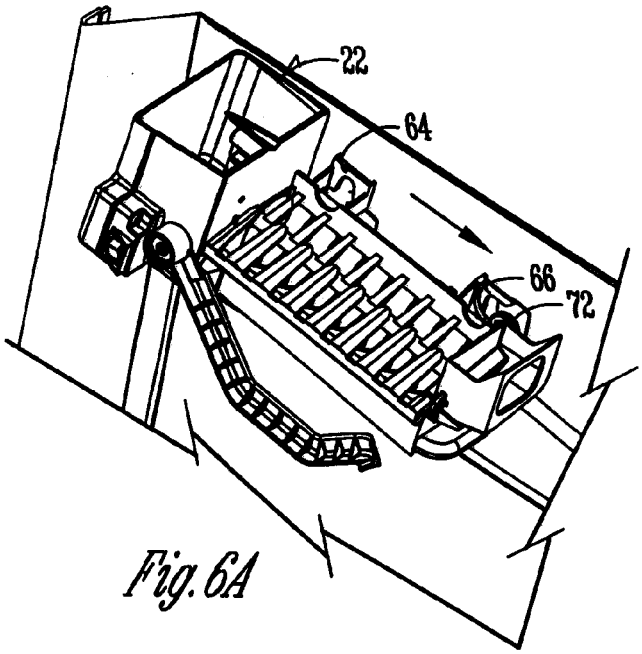
FIGS. 6A-C illustrate a mounting method of placing the icemaker upon button mountings.
Figure 6B:
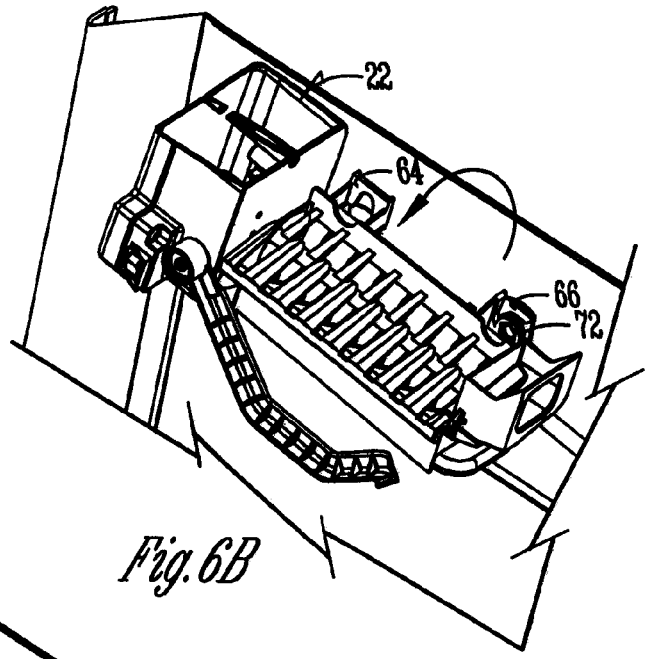
Figure 6C:
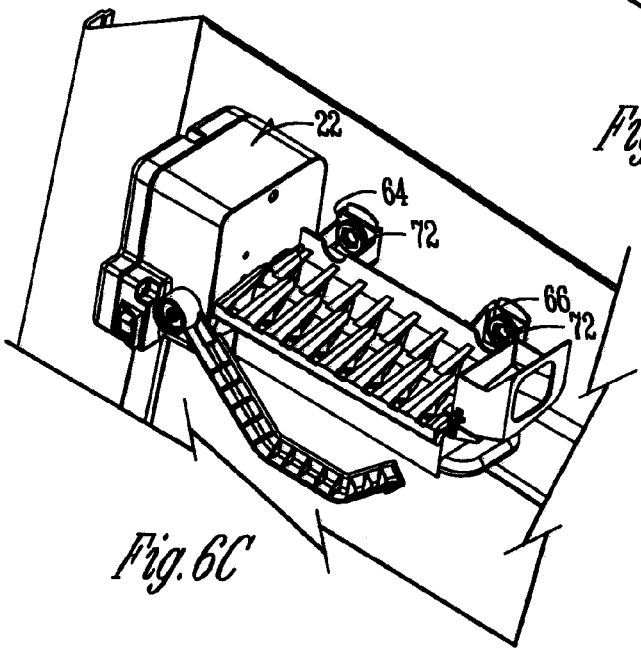

An alternative form of the brackets is seen in FIG. 6A-C. In these figures, two different types of brackets are provided, namely a first bracket 64 with longitudinal channel a second bracket 66 with a lateral channel. The lateral channel bracket 66 is of a position on the icemaker that is away from the installer. As seen in FIG. 6A, the installer inserts the lateral channel bracket 66 upon the button 72 laterally. Then, as seen in 6B, the user rotates the icemaker assembly downward such that the longitudinal channel bracket 64 comes down upon another button 72.

c. Impingement Duct Mounting

Figure 7:
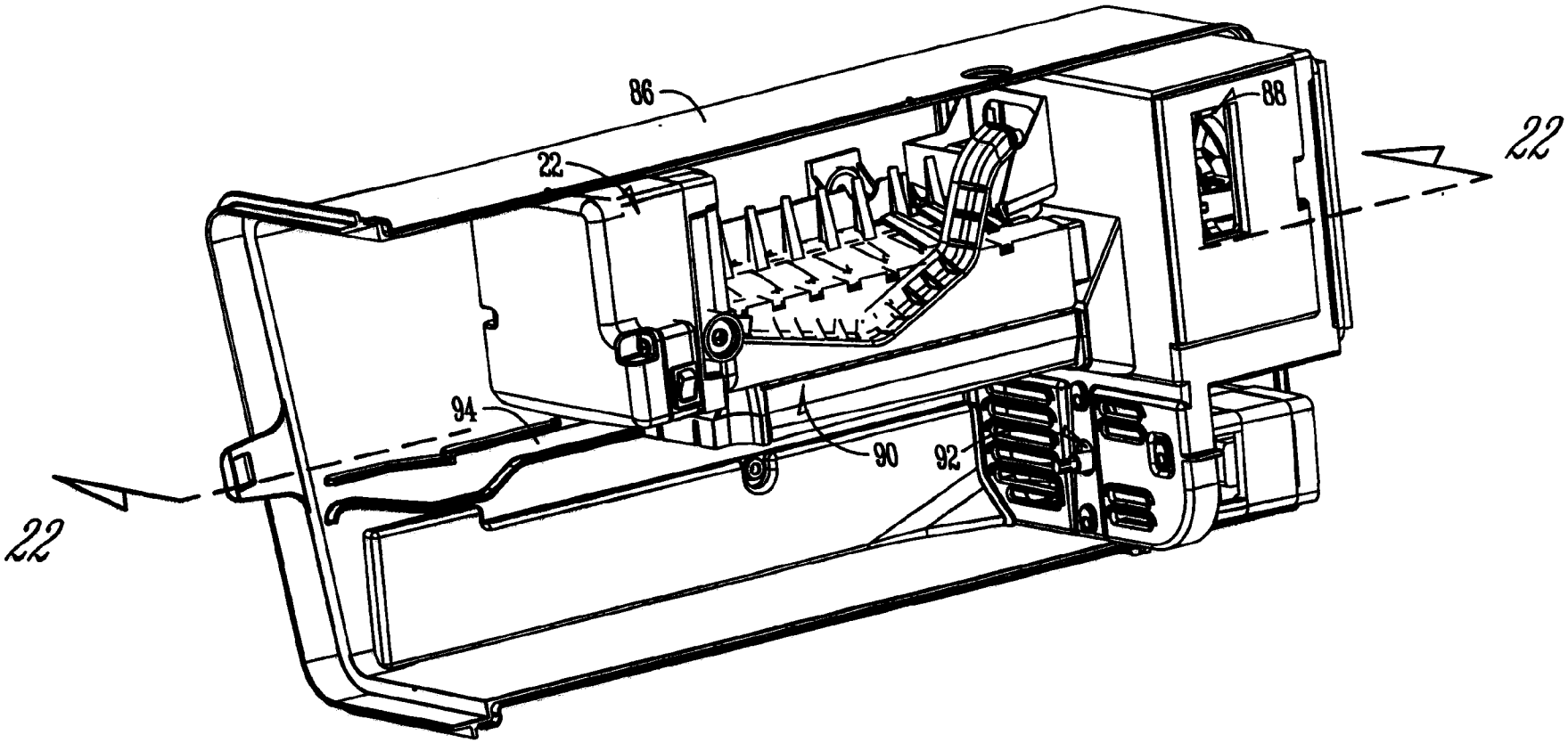
FIG. 7 is a perspective view of the icemaker in use within a specialty icemaking compartment (icebox).

FIG. 7 illustrates a third way of mounting the icemaker within a storage compartment 14 by placing it within an ice box 86. The icemaker 22 is fastened to an assembly that includes a fan assembly 88, an impingement duct 90 connected to the fan assembly 88 and positioned beneath the ice mold 28, and an auger assembly 92. The impingement duct 90 has an integrally molded rail (not shown) that slides within a guide 94 upon the side of the ice box 86. The icemaker 22 is attached to the impingement duct 90 and held within the ice box 86 by virtue of the molded rail upon the impingement duct 90.

Control of External Fan

As shown in FIG. 7, the fan assembly 88 is used to blow air onto the mold body. A control system may be provided for the icemaker 22 which controls when the fan assembly 88 operates. Using such a control system, the fan assembly 88 is not permitted to turn on when the icemaker is harvesting ice because at this time heat is applied to the icemaker mold body during harvest through a heating coil 57. If cold freezer air is not forced to the mold body during an ice harvest, the mold body heats up faster, allowing a faster ice harvest rate. It should be noted that the control system may be used to control the freezer's evaporator or other fan not illustrated in FIG. 7.

Externally Mounted Thermostat

Figure 8:
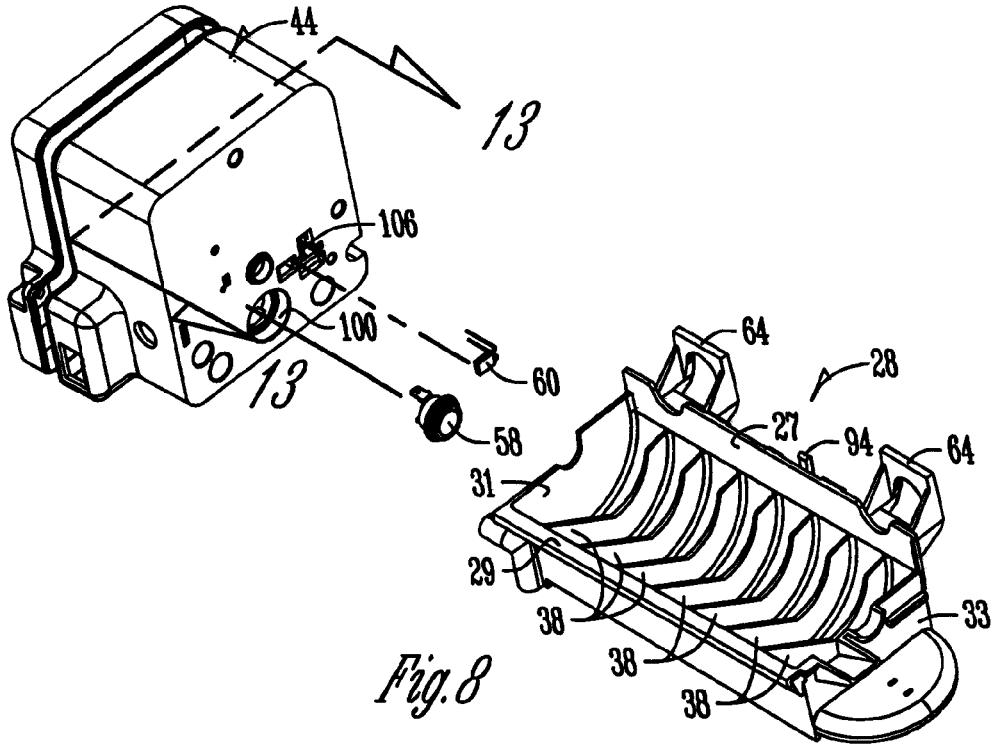
FIGS. 8-14 illustrate aspects of the icemaker's thermostat and thermal cutoff sensor.
Figure 9:
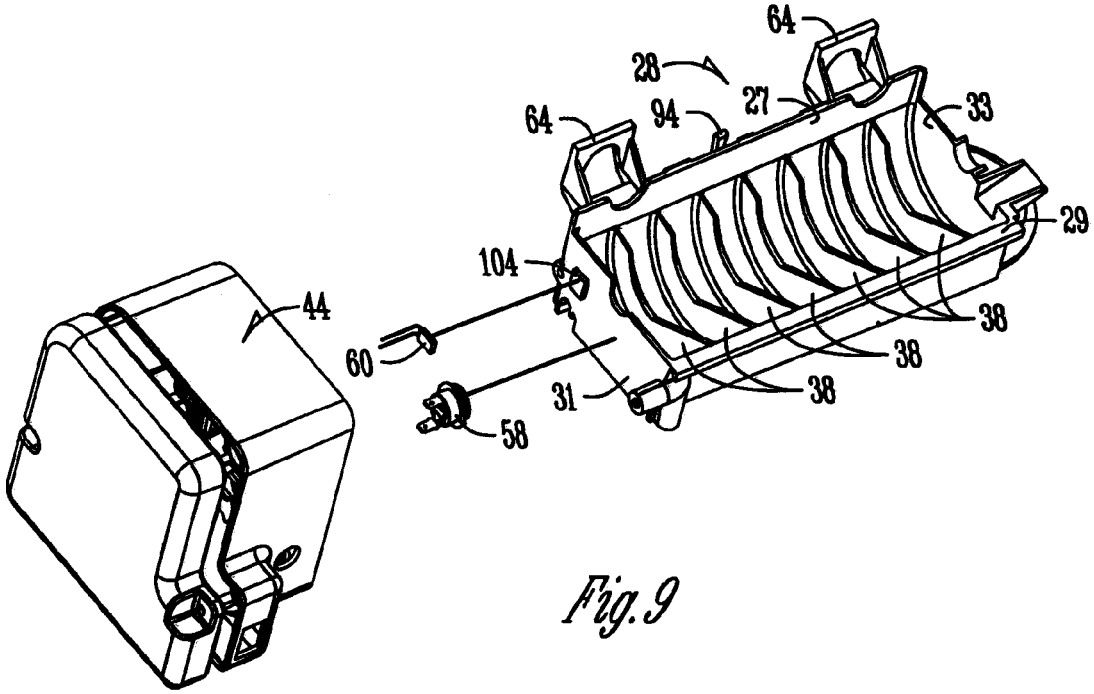

As seen in FIG. 8-12, the externally mounted thermostat 58 is positioned between the control housing 44 and the mold 28. The mold 28 in FIGS. 8 and 9 is illustrated with only components that are integrally molded together. The mold is preferably made from aluminum or other heat conductive material.

Figure 10:
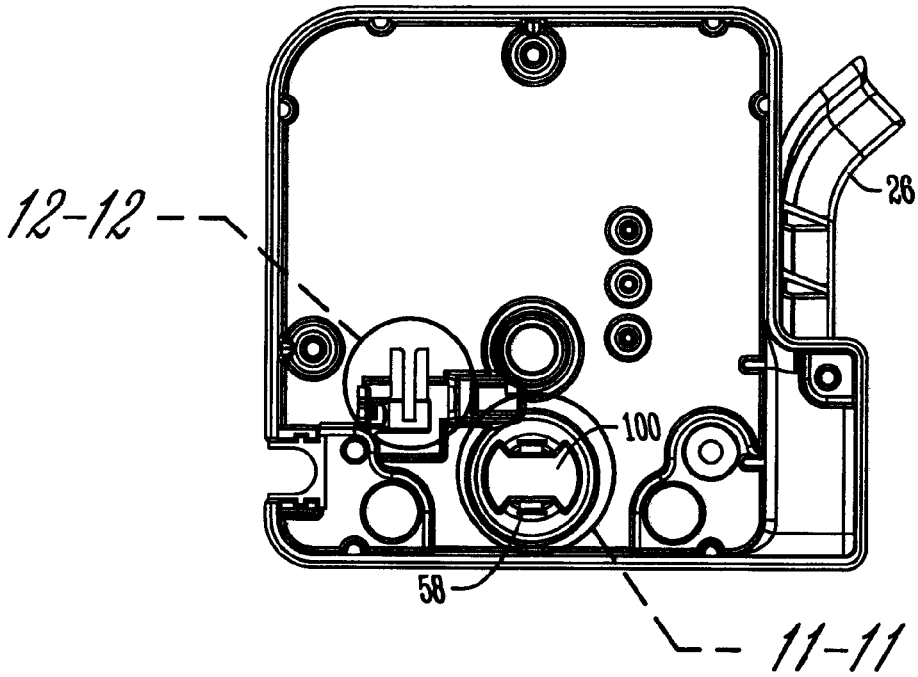

As most clearly illustrated in FIG. 8, the thermostat 58 is placed within an orifice 100. Opposite the orifice 100, a flat surface of the mold 28 is provided to press against the thermostat 58 and hold it firmly in place. As seen in FIG. 10, the back side of the thermostat 58 has electrical connectors extending through the orifice 100. A cross section of the thermostat 58 within the orifice illustrates that a thin gap 102 may be present between the thermostat 58 and the mold 28. The gap 102 may be filled with a conductive grease-like material to facilitate effective heat transmission from the mold 28 to the thermostat 58. This improvement is in contrast to the prior art which used a spring to push the thermostat into intimate contact with the mold; in sharp contrast, the externally mounted thermostat 58 is locked between the control housing 22 and the mold 28.

Improved Thermal Cut-Off Location

As also in FIG. 8-10, 13-14, the thermal cut-off switch 60 is positioned to contact mold 28 at an integrally formed extension member 104. The extension member 104 is inserted into the control housing 44 through an opening 106. The thermal cut-off switch (TCO) 60 is a safety element. The thermal cut-off switch 60 is a fuse that melts if the mold body temperature rises above 160° F. When the TCO melts, the current flow stops and cuts off power to the icemaker or the heater coil from the icemaker thus preventing excessive temperature rise.

Figure 13:
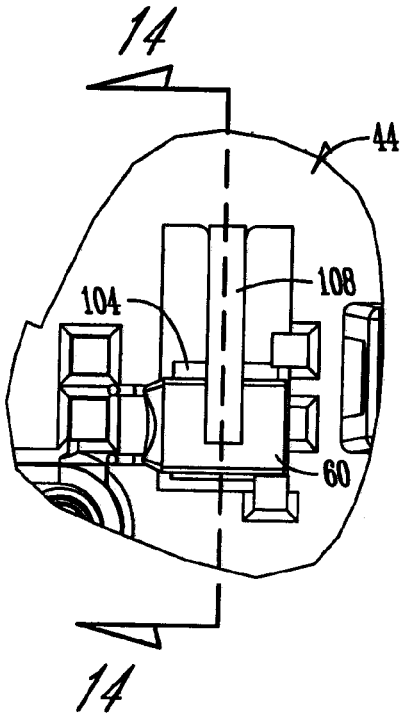
Figure 14:
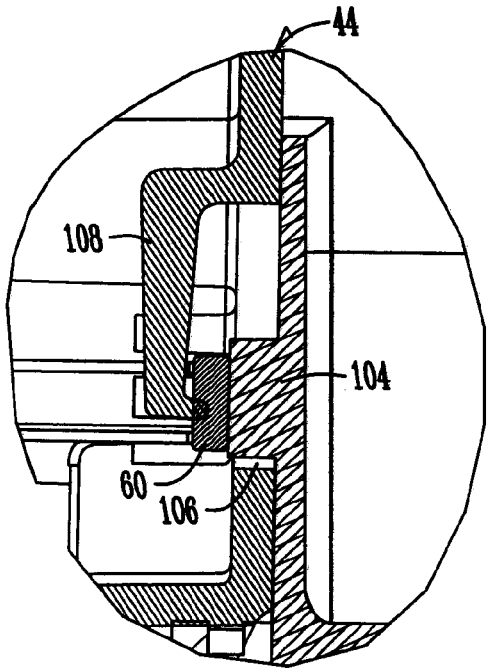

As seen in FIGS. 13-14, the thermal cut-off switch 60 is held in contact with the extension member 104 by a finger 108 biased toward the opening 106. As opposed to the prior art that positions the thermal cut-off switch 60 within the opening 106, the improved thermal cut-off location protects the switch 60 from damage within the control housing and forms better contact with the mold 28 by contacting the extension member 104. Additionally, the prior art requires the use of a conductive grease-like material to facilitate effective heat transmission as opposed to applicant's thermal cut-off switch 60 which is positioned in intimate contact with the extension member without a conductive grease-like material. It should be noted that applicant's invention may use a conductive grease-like material as an additional precaution.

Modular Bale Arm

Figure 15:
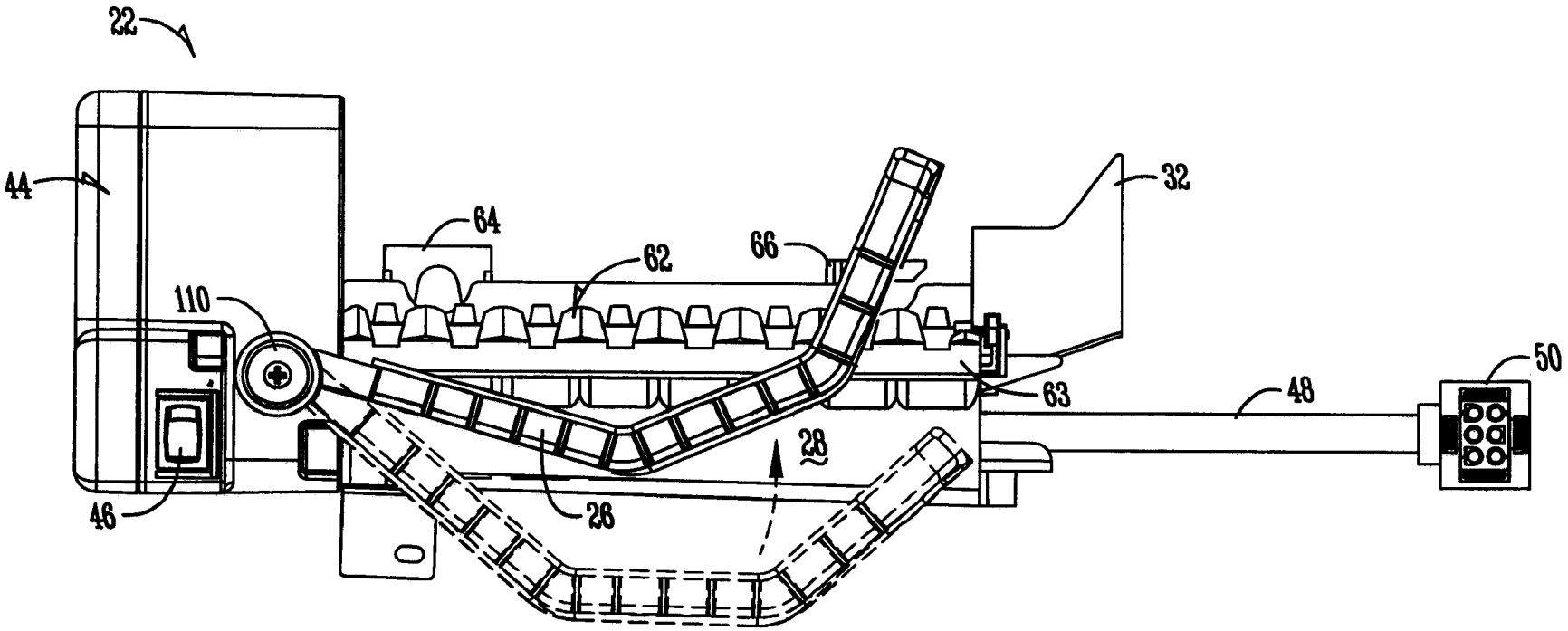
FIG. 15 illustrates a side view of the icemaker and its modular bale arm.

As seen in FIG. 15, the modular bale arm 26 is mounted to the control housing 44 by a rotating base 110. The bale arm 26 is comprised of three different formed portions. When in a lowered position these portions are identified as a first portion that angles downward from the rotating base 110, a second, center portion that is parallel relative the icemaker, and a third portion that angles upward from the second portion. The bale arm 26 pivots for movement in a vertical plane between a lowered position in which ice is permitted to be made and an upper position in which ice production is stopped.

Icemaker Heating Coil

Figure 16:
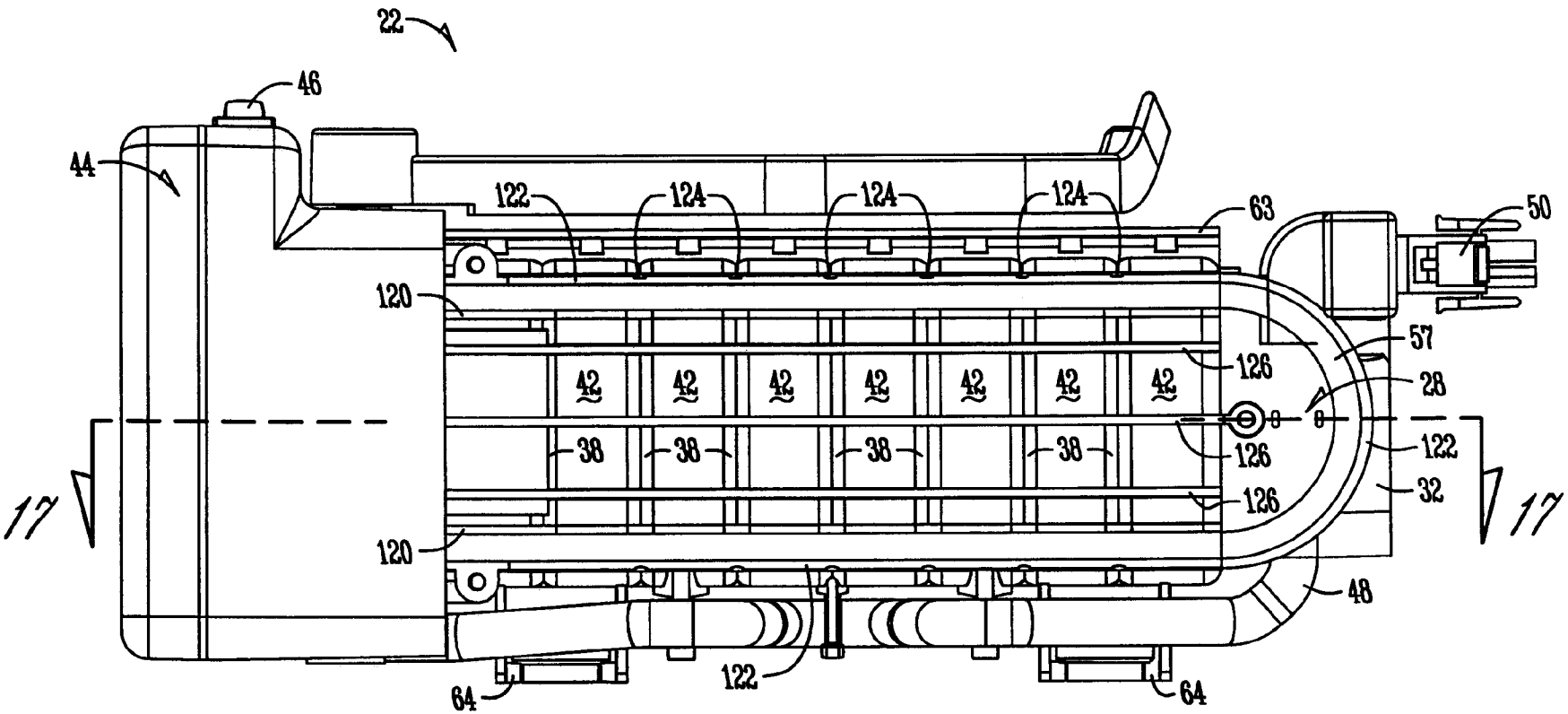
FIG. 16 is a bottom view of the icemaker illustrating the crimping of the heating element.

The bottom side of the icemaker 22 is illustrated in FIG. 16. Along the bottom of the mold 28, the individual ice cube cavities 42 have a bottom side that is slightly curved as it approaches the weirs 38. Each weir 38 bottom side is shown with a slight indentation.

A heating coil 57 runs along the channel defined by an outer ridge 122 and an inner ridge 120. The heating coil 57 has side portions that have a higher wattage than the end away from the control housing. This difference in wattage prevents the ice cube portion 42 furthest from the control housing 44 from melting faster than the other cubes. The heating coil is held within this channel by a series of crimps 124. The crimps 124 are preferably located over the weirs 38. Alternatively, the crimps 124 may be located upon the ice cube cavities 42. These crimps 124 assist in conduction of energy from the heating coil to the ice mold 28. Thermally conductive grease or mastic may be provided between the heating coil and the bottom of the mold 28 to further enhance heat conduction.

In normal operation, the last cube to be frozen should be the ice cube portion in contact with the thermostat 58 because as soon as the thermostat 58 registers that ice has been formed in that ice cube portion the thermostat will trigger the ejector arm 54 to empty the ice mold 28. If the ice cube portion nearest the control housing 44 were to freeze prior to the others, the ejector arm may be operated when the other ice cubes have not been completely formed, thus causing a spill.

In the prior art, only one or two crimps are formed through a clinching process on the side wall of the icemaker 10 to press it against the heat exchanger. The prior art crimps were designed to basically hold the heat exchanger against the bottom of the icemaker 22. However, having only one or two crimps causes inconsistent hot spots and excess residual water.

Longitudinal Running Bottom Fins

As further seen in FIG. 16, the icemaker 22 has fins 126 on the bottom of the mold 28. The fins 126 promote convective heat transfer away from the bottom of the ice mold 28 and more rapid freezing of water within ice cavities 42.

Figure 17:
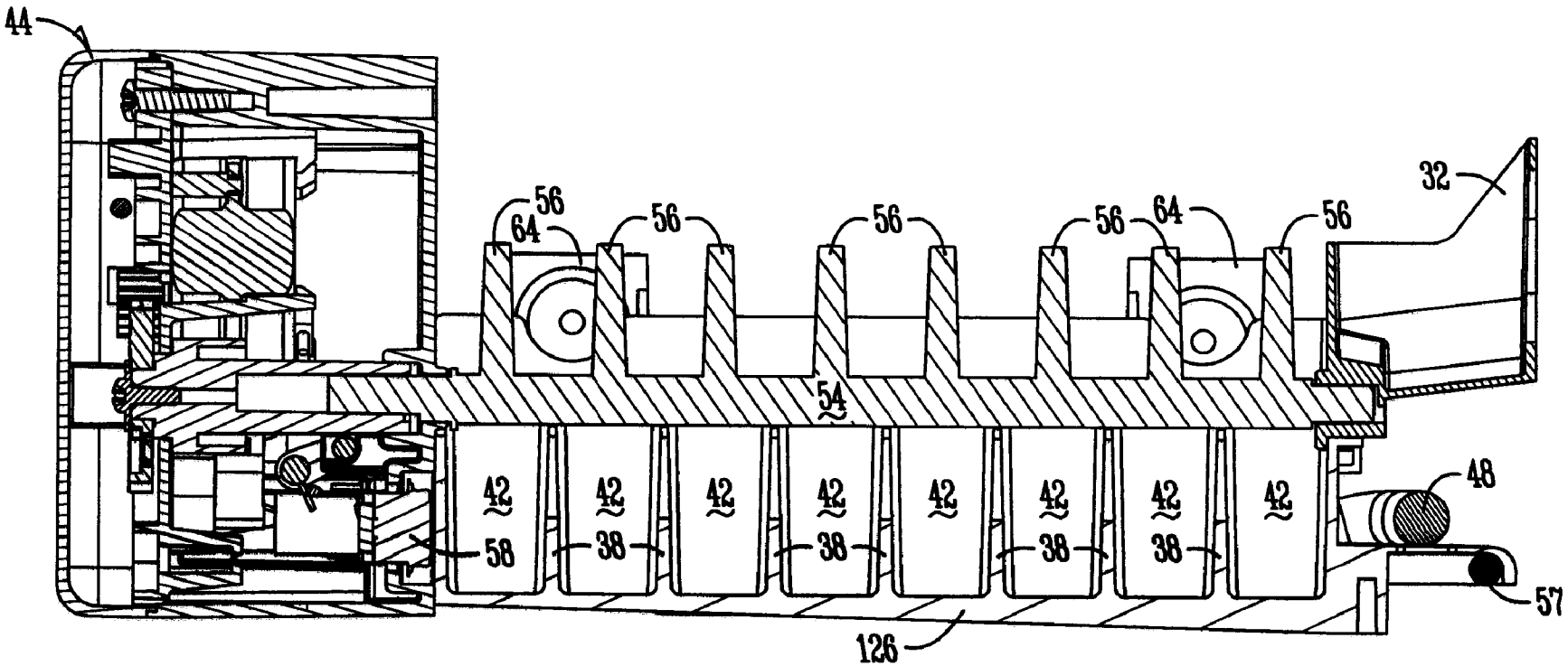
FIG. 17 is a side cross sectional view of the icemaker.

As seen in FIG. 17, the fins are tapered from a wide portion away from the control housing 44 to a narrow portion near the control housing. The shape is particularly useful should the icemaker 22 be used with a refrigerator with a conventional vent at the rear of the freezer compartment. The fins 126 make a marked improvement by directing this air along a pathway along the bottom of the icemaker mold.

Raised Walls for Non-Spill Feature

As further seen in FIGS. 7 and 8, the icemaker 22 is provided with side walls 27, 29 and end walls 31, 33 which cooperate to have a no-spill feature that prevents water from going over the side of the icemaker 22 and into the ice storage bin 24. At least the side wall 27 and the end wall 31 extend above the tops of the weirs 38. The side and end walls of the ice mold 28 cooperate to have a minimum continual wall height about the periphery based on end user potential alignments. For example, an icemaker 22 may be mounted incorrectly or the refrigerator may be placed on uneven ground. Specifically, the walls provide the icemaker with tolerances which permits the icemaker to be positioned +/−5.6 from front to back and +/−10.2 from side to side.

Tilted Forward Ice Cube Tray

As seen in FIG. 18, the icemaker 22 may be positioned with the control housing 44 mounted toward the front of the cabinet 12 and plugged into a ceiling of the cabinet 12. As illustrated the icemaker 22 is mounted at an angle such that the ice mold 28 is approximately 1.5° higher at the back end than at the door end of the icemaker.

During a fill cycle, water enters into the fill cup 32 and flows along the ice mold 28. An angled icemaker 22 helps assure that the ice cube cavity 42 nearest the control housing 44 is filled so that the thermostat 58 will get an accurate reading. The thermostat reads the temperature in the ice cube cavity 42 and controls the function of the ice ejector 54 to release ice from the ice cube cavities 42. The ice cube tray 16 is 1.5° higher at the back of the ice mold 28 than at the front end of the ice mold 28. This orientation assures that the ice cube portion 42 nearest the control housing 44 is filled so that an accurate measurement of the temperature is recorded by the thermostat 58.

Additionally, the 1.5° tilt allows extra aluminum 24 to be added at a back end of the icemaker 22 (see FIG. 2) to provide greater heat transfer to the back ice cube portions to enable them to freeze prior to the ice cube portion 42 in contact with the thermostat 58.

Lower Front Weirs

Preferably, the weirs 38 are of different heights to accommodate the 1.5° tilt. An alternate icemaker may have the first 1-2 weirs from the control housing having a bottom point opening lower than the weirs farthest from the control housing 44. This configuration assures that water enters into the ice cube cavity 42 nearest the control housing 44 and adjacent the thermostat 58.

Improved Ice Ejector

Figure 19:
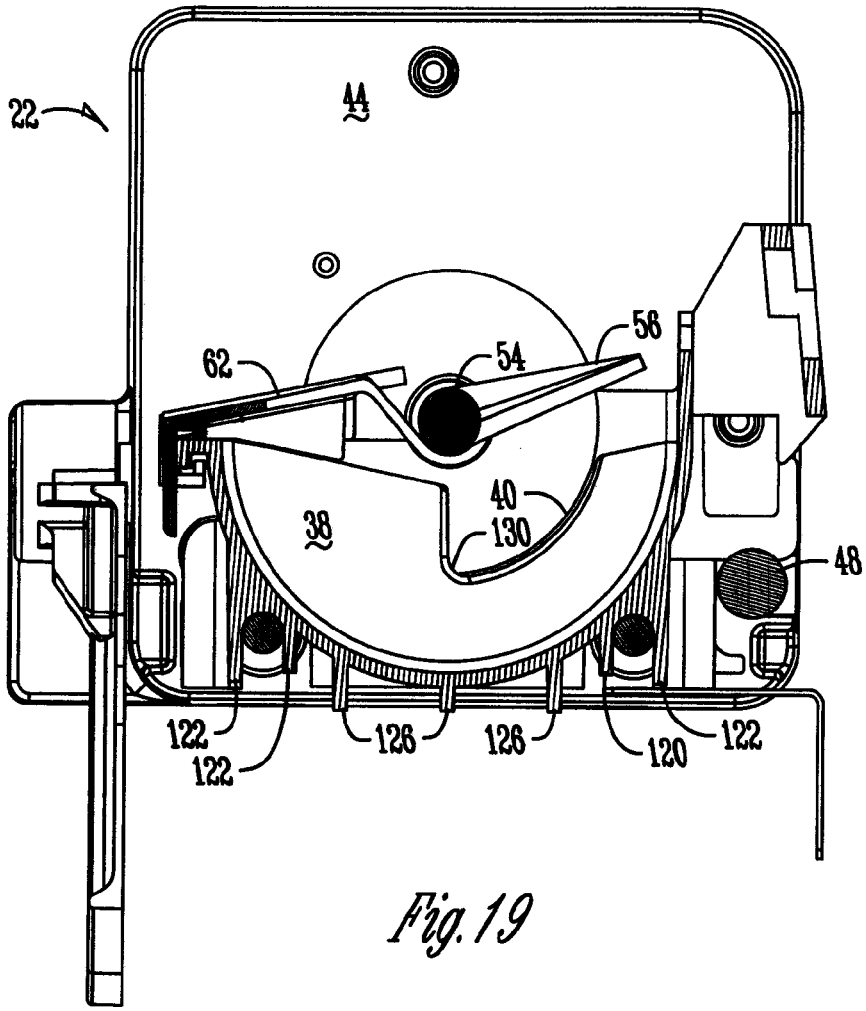
FIG. 19 is a cross sectional view of the icemaker showing the weir configuration and the positioning of the ice ejector arm.

As seen in the cross section of the icemaker FIG. 19, an ejector arm 54 having fingers 56 is used to eject ice from the ice mold 28. The ejector arm 54 is located approximately 0.5" above the lowermost opening of the weir 38 and turns in a circular path about a central axis. The present invention's ejector arm 54 is positioned and turns such that the ejector arm 54 does not interfere with the crown of ice that is formed during the normal freezing process. The present ejector arm 54 is in contrast with prior art ejector arms that are mounted lower, or are offset or eccentrically mounted so as to turn in a non-circular or elliptical path.

Mold with Center Weir Opening

Figure 20:
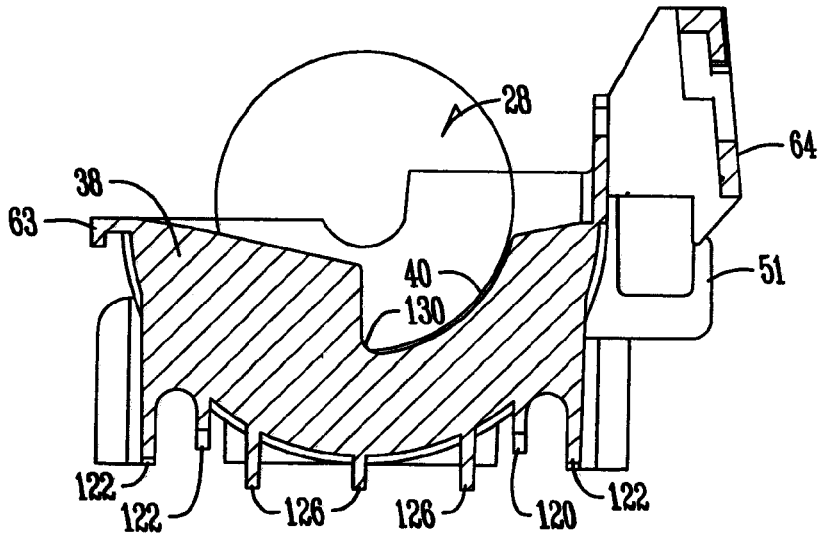
FIG. 20 is a sectional view of a weir of the icemaker.

As seen in both FIGS. 19 and 20, the weir 38 has a bottom point 130 of the opening 40 located along the weir centerline. This placement of the weir bottom point 130 allows the maximum side to side angle flexibility. The weirs as illustrated permit an ice mold 28 to function properly at angles between +/−5.6° about the lateral axis in between +/−10.2° about the longitudinal axis. This is in contrast to the prior art icemakers that position the weir openings 40 significantly off to one side of the ice mold 28.

Wire Routing Mold Hooks

Figure 21:
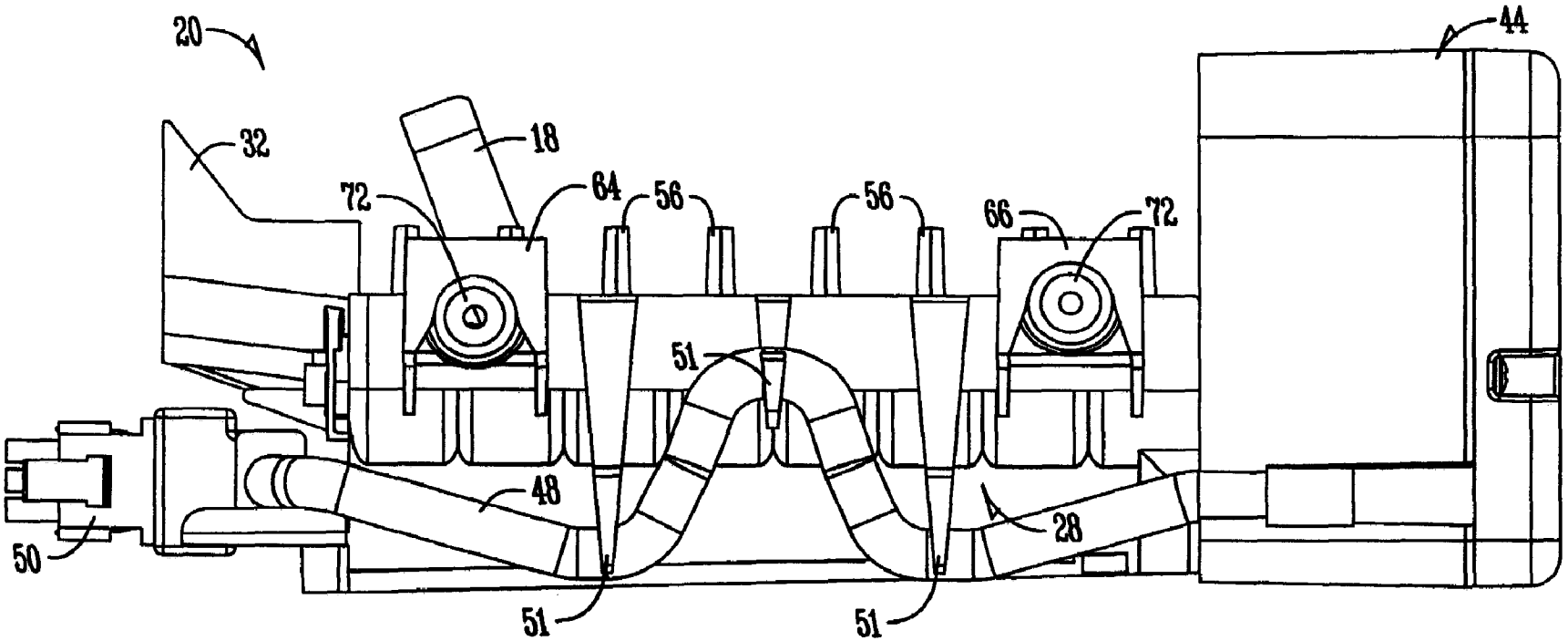
FIG. 21 is a side view of the icemaker showing the wire cable and wire mounting hooks.

As seen in FIG. 21, the icemaker 22 has wire routing hooks 51. These hooks 51 are integrally formed with the ice mold 28. These hooks 51 together form a runway for the cable 48. These hooks 51 are particularly useful because they permit a single length cord 48 to be preassembled to the icemaker 22 and used for many different refrigerator models despite the icemaker 22 being positioned at different locations in the ice storage compartment 14 for these models. The cord 48 fits a variety of different icemakers but because it must be longer to accommodate some icemakers and shorter for others, portions of it are wrapped around the hooks 51.

Fill Cup Funnel Inlet

As further seen in FIG. 21, the fill cup 32 may be provided with a funnel inlet that is outwardly splayed to permit easier installation of the icemaker upon a production line or for a consumer to install a retrofit icemaker within a freezer. The funnel inlet solves the problem associated with a water inlet tube missing the fill cup 32 during installation and causing water to fill the ice storage compartment 14 as opposed to the ice mold 28.

Impingement Duct

Figure 22:
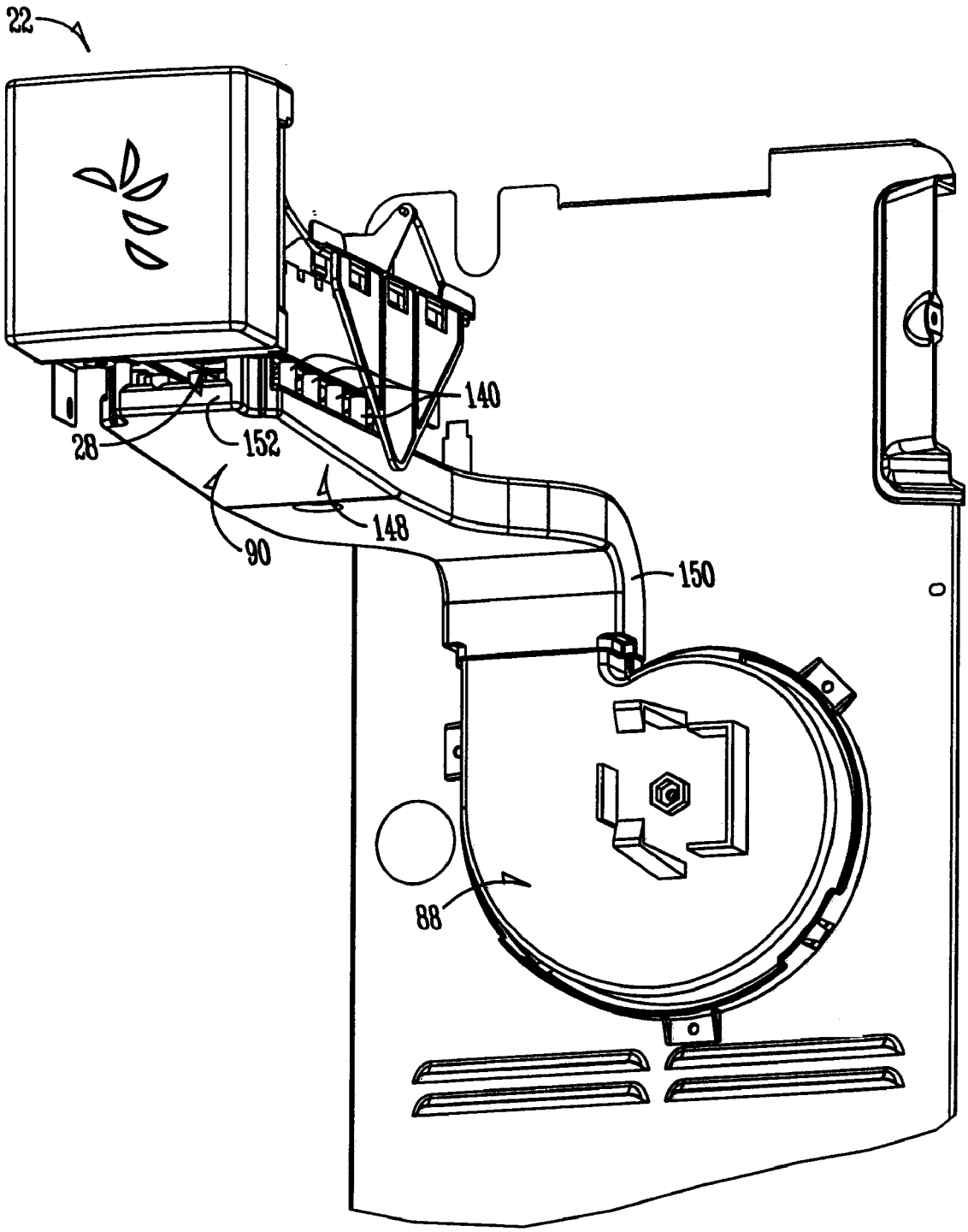
FIGS. 22 and 23 illustrate the impingement duct in use with the icemaker of the present invention.
Figure 23:
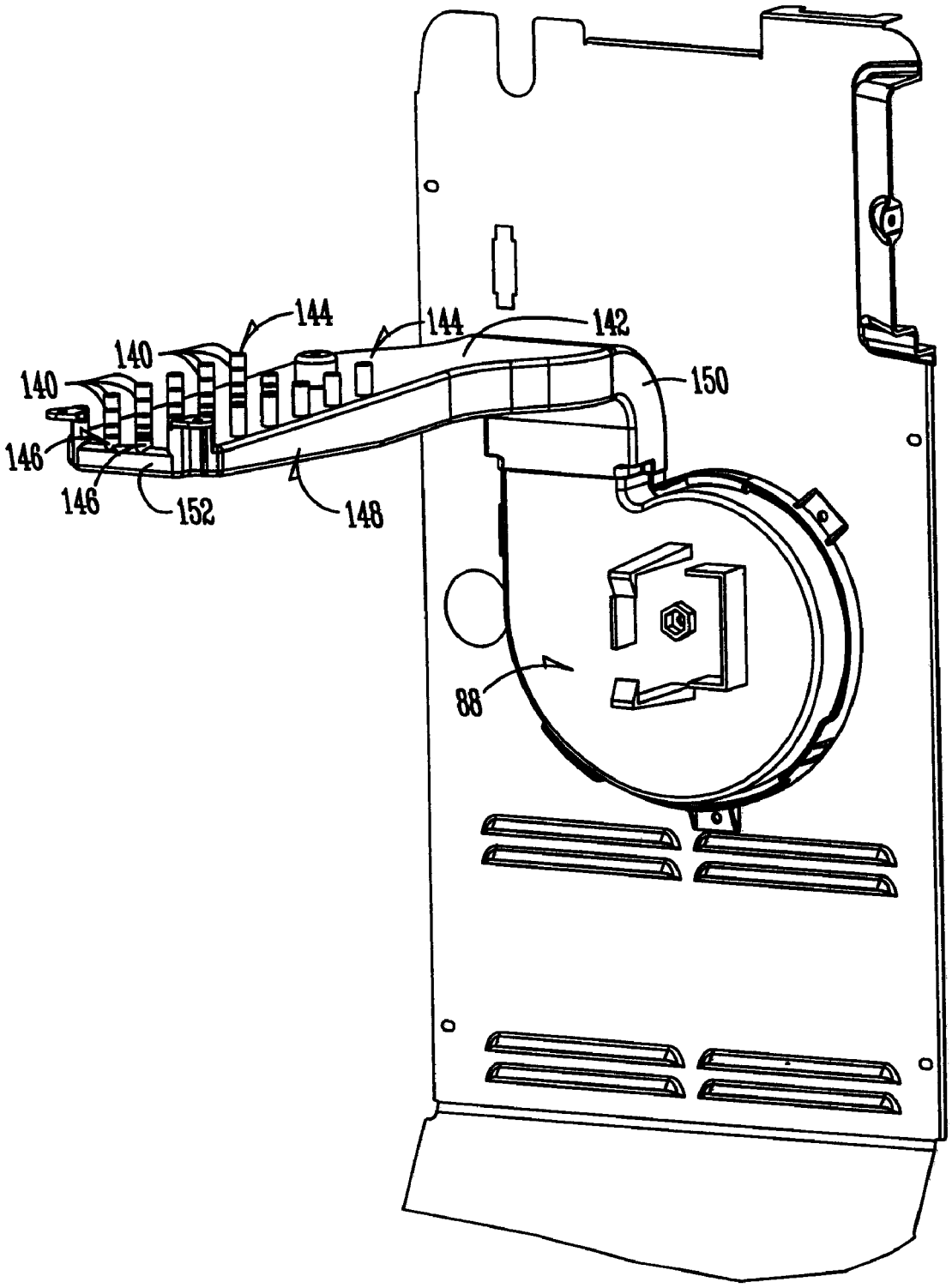

As seen in FIGS. 7, 22 and 23, the impingement duct or manifold 90 is provided directing an array of air jets 140 to the ice mold. As shown in FIG. 7, the impingement duct 90 can be mounted under applicant's improved icemaker 22 or under a prior art icemaker as illustrated in FIG. 22. The icemaker 22 using the impingement duct 90 produces ice two to three times faster than an icemaker without an impingement duct. Thus, the impingement duct 90 is particularly useful for refrigerators having a compact icemaker or rapid ice production feature.

As seen in FIG. 23, the impingement duct 90 has a rectangular base 142 from which the air jets 140 extend upward. As illustrated, the air jets 140 have a diameter between 0.2-0.25 inches. There are eight rows of air jets 140 that are directed under each of the eight ice cavities. These eight rows may be further divided into four columns, two outer rows 144 and two inner rows 146. The outer rows 144 are higher than the inner rows 146 to follow the shape of the ice cavity 42. It is understood that the number of rows and columns of air jets may be varied without departing from the scope of the invention.

The air jets 140 are specifically designed to disrupt the thin boundary layer of air that is warmed by the water freezing in the ice mold 28 and to provide a continuous supply of freezer temperature air. The configurations of the nozzles are either round, slotted or the like. The actual diameter of the nozzles, the space between adjacent nozzles, and distance between the surface of icemakers and nozzles are optimally designed to obtain the largest heat transfer coefficient for an airflow rate.

An air channel or plenum 148 is beneath the air jets 140. The air channel has a wide end 150 that receives air from a fan assembly 88 and than tapers to a closed end 152. The taper permits a balanced airflow distribution to all air jets 140.

The cooling capacity of the air jets is provided from the freezer itself. The fan assembly 88 has an AC or DC power supply with a small power consumption of up to 3-5 watts in order to reduce impact of heat from the fan motor in the refrigerated space.

Water-Fill Location at the Sensor End of the Icemold

The icemaker 22 may be altered to have the water fill tube 30 fill the ice cavity 42 in contact with the thermostat 58 first. This fill location is significant because it increases the probability that the thermostat 58 will measure a properly filled ice cavity 42.

Icemakers that fill the ice mold 28 from the opposite end of the mold in relation to the sensor may leave the cube nearest the thermostat unfilled. This is particularly a problem in low water fill situations such as homes with low water pressure and may result in quality problems and service calls. When the cube nearest the thermostat is not properly filled, the ejector arm 54 is likely to be engaged while some of the ice cavities 42 still contain liquid.

Multiple Temperature and Water Fill Level Sensors

The icemaker 22 may be altered to include multiple temperature sensors. Icemakers that initiate an ice harvest based upon a single temperature sensor are subject to a variety of failures that are caused by the combination of water quantity, air flow/heat transfer, levelness of the icemaker, temperature sensor location, and other. Essentially, the icemaker 22 may be determined to be too long with respect to the location of a single temperature sensor.

The icemaker 22 may incorporate multiple water level sensors positioned along the length the row of ice cavities 42. Using two or more water level sensors will provide information about the fill volume and levelness condition of the icemaker. This information can be used in an icemaker control algorithm to provide the optimum fill volume and the correct harvest initiation. The use of multiple water level sensors results in reliable ice production with conventional water supply technology, conventional temperature sensing means, and typical airflow/heat transfer, and typical installation parameters.

Icemold Having a Larger Ice Cavity Near Temperature Sensor

The icemaker 22 may be altered to include a larger ice cavity 42 near the thermostat 58. Such a larger ice cavity 42 would produce a large ice cube that would freeze slower than the rest of the ice cubes. As the thermostat registers the temperature of the large ice cube, this would prevent premature ice harvest, one reason for failures and service calls on refrigerators containing icemakers in their freezer portion. The larger ice may have a modified dispensing system and may require slightly longer ejector fingers 56.

This inventive feature is in contrast to icemakers with symmetrical compartments for all ice cubes. The prior art thermostat controlled icemakers often have a time delay or other active means to compensate for the possibility for a hollow ice problem (where the center of the ice cube is still liquid water). In the present invention, the large ice cube portion located next to the thermostat passively delays the activation of the thermostat and subsequent harvest mechanism. This has the potential to be an energy savings and the modification is passive requiring no other energy to be expended. This invention is particularly useful to applications that require increased ice harvest rates.

Individual Fill of Ice Mold Cavities

The icemaker 22 may be altered to include multiple water fill tubes. Such a configuration permits more uniform distribution of water to each cavity 42. One such method of accomplishing this is through the utilization of a supply manifold.

In contrast, current icemakers use a single point in which the mold body is filled with supply water. As the mold body is filled, the supply water over flows the dividing walls (weirs 38) of the individual ice cube cavities with the intent of filling the entire mold with supply water. An unlevel installation creates problems for this type of design. The tilt of the icemaker may not allow the supply water to sufficiently fill the cavities on the high end of the mold body, and/or may cause too much water in cavities on the low end. This can lead to an overflow of the icemaker and/or problems with ice harvesting such as hollow cubes, excessive wetting, and ejector arm stalls.

Straight Shot of Fill Water Down the Mold Lower Weir Side

As seen in FIGS. 19 and 20, the ice mold 28 has one side of the weir 38 open for water flow. The icemaker 22 may be altered to position the fill tube 30 in alignment with this opening so that water flowing from the fill tube takes a direct path.

The prior art icemakers provides a fill tube that directs water flowing into the mold body along a circuitous path that slows the entry of the water into the ice cavities 42. As proposed, this may be improved upon by getting water to flow in a direct path down the open side of the weir 38 and thereby allowing momentum to minimize water surface tension and its effects upon water flow and filling of the individual ice cube cavities.

Stepped Mold

The icemaker 22 may be altered to included a stepped ice mold to improve the ability of the icemaker to operate correctly when installed in an unlevel condition. The icemaker mold is given a stepped orientation in which the mold fills from the top, and cascades into each lower cube. The harvest or fill sensor can be located at any cube, but top and/or bottom are thought to be the preferred sensor locations. The stepped orientation of the ice mold would make the icemaker no more sensitive to unlevelness than any single cube. The slope of the icemaker steps must be greater than the largest degree of unlevelness that the icemaker will see.

What is claimed is:

1. A refrigerator comprising:

a food storage compartment;

a door on the compartment;

an icemaker mounted within the storage compartment and having a mold having separating weirs to create cavities in which water is frozen to form ice cubes;

a water fill tube supplying water to the icemaker;

a plurality of hooks provided on the mold for receiving an electrical cord.

2. The refrigerator of claim 1 wherein the hooks are integrally formed with the mold.

3. The refrigerator of claim 1 wherein the icemaker is tilted.

4. The refrigerator of claim 1 further comprising a thermostat to monitor temperature of the mold.

5. The refrigerator of claim 1 wherein the icemaker has mounting brackets for mounting the icemaker within the storage compartment.

6. The refrigerator of claim 1 further comprising an impingement duct that directs air to the ice cavities.

7. The refrigerator of claim 1 wherein the icemaker includes a control housing and a thermostat is positioned between the control housing and the ice mold.

8. The refrigerator of claim 1 further comprising projections adjacent the mold to control air flow so as to enhance heat transfer to facilitate rapid ice formation.

9. The refrigerator of claim 1 further comprising a bale arm pivotally mounted for movement in a vertical plane.

10. The refrigerator of claim 1 wherein the icemaker weirs have a center opening to assure the ice cavity nearest the thermostat is filled with water.

11. An improved refrigerator having a food storage compartment with a door, the improvement comprising:

an icemaker mounted in the storage compartment and having a mold for forming ice pieces; and hooks provided on the mold to support electrical wiring.

12. The improved refrigerator of claim 11 wherein the icemaker has a mold with weirs defining ice cube cavities.

13. The improved refrigerator of claim 12 wherein the hooks are integrally formed with the mold.

14. The improved refrigerator of claim 11 further comprising a thermostat to monitor the temperature of the icemaker.

15. The improved refrigerator of claim 11 wherein the icemaker is tilted.

16. The improved refrigerator of claim 11 wherein the icemaker has mounting brackets for mounting the icemaker within the storage compartment.

17. The improved refrigerator of claim 11 further comprising projections adjacent the icemaker to control air flow so as to enhance heat transfer to facilitate rapid ice formation.

18. The improved refrigerator of claim 11 further comprising a bale arm pivotally mounted for movement in a vertical plane.

19. The improved refrigerator of claim 11 wherein the icemaker has exterior walls and interior walls defining ice cavities, with the exterior walls being taller than the interior walls.

* * * * *